US010170845B2

(12) United States Patent
Ju

(10) Patent No.: US 10,170,845 B2
(45) Date of Patent: Jan. 1, 2019

(54) PLUG CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/805,284

(22) Filed: Nov. 7, 2017

(65) Prior Publication Data

US 2018/0145425 A1 May 24, 2018

(30) Foreign Application Priority Data

Nov. 23, 2016 (CN) ..... 2016 2 1258588 U

(51) Int. Cl.

| | |
|---|---|
| ***H01R 4/02*** | (2006.01) |
| ***H01R 13/11*** | (2006.01) |
| ***H01R 24/22*** | (2011.01) |
| ***H01R 24/28*** | (2011.01) |
| ***H01R 107/00*** | (2006.01) |
| ***H01R 13/428*** | (2006.01) |
| ***H01R 13/627*** | (2006.01) |
| ***H01R 13/6581*** | (2011.01) |

(52) U.S. Cl.

CPC ..... *H01R 4/023* (2013.01); *H01R 13/428* (2013.01); *H01R 13/6273* (2013.01); *H01R 13/6581* (2013.01); *H01R 24/22* (2013.01); *H01R 24/28* (2013.01); *H01R 13/112* (2013.01); *H01R 2107/00* (2013.01)

(58) Field of Classification Search

CPC ..... H01R 24/22; H01R 24/60; H01R 23/688; H01R 23/6873; H01R 23/7073; H01R 23/02; H01R 4/023; H01R 13/428; H01R 13/6273; H01R 13/6581; H01R 13/112; H01R 24/28; H01R 2107/00

USPC ..... 439/108, 607.05, 660

See application file for complete search history.

(56) References Cited

U.S. PATENT DOCUMENTS

| | | | | |
|---|---|---|---|---|
| 9,590,363 | B2 * | 3/2017 | Wu | H01R 13/6585 |
| 9,627,826 | B2 * | 4/2017 | Wu | H01R 24/60 |
| 9,660,369 | B2 * | 5/2017 | Lee | H01R 12/778 |
| 9,735,522 | B2 * | 8/2017 | Chen | H01R 24/62 |
| 9,780,505 | B2 * | 10/2017 | Peng | H01R 24/60 |

(Continued)

FOREIGN PATENT DOCUMENTS

| | | |
|---|---|---|
| CN | 201708323 U | 1/2011 |
| CN | 205335539 U | 6/2016 |
| TW | M517453 U | 2/2016 |

*Primary Examiner* — Gary F Paumen

(74) *Attorney, Agent, or Firm* — Locke Lord LLP; Tim Tingkang Xia, Esq.

(57) ABSTRACT

A plug connector includes an insulating body, two power terminals arranged on the insulating body, and a cable having at least two power wires. A mating portion is provided at a front end of the insulating body. The mating portion is recessed with a mating slot from front to back. The mating slot has a first width in a left-right direction. Each power terminal has at least one contacting portion protruding and extending into the mating slot. The two power terminals are conducted and are provided with a second soldering portion. The second soldering portion has a second width in the left-right direction, which is greater than one third of the first width. The at least two power wires are connected to the second soldering portion.

20 Claims, 10 Drawing Sheets

(56) References Cited

U.S. PATENT DOCUMENTS

| | | | | |
|---|---|---|---|---|
| 2004/0043658 | A1* | 3/2004 | Ko | H01R 12/714 439/607.56 |
| 2015/0340791 | A1* | 11/2015 | Kao | H01R 24/60 439/676 |
| 2016/0322753 | A1* | 11/2016 | Cheng | H01R 13/631 |
| 2016/0380387 | A1* | 12/2016 | Wu | H01R 13/6581 439/95 |
| 2017/0093091 | A1* | 3/2017 | Cheng | H01R 4/023 |

* cited by examiner

PLUG CONNECTOR

CROSS-REFERENCE TO RELATED APPLICATIONS

This non-provisional application claims priority to and benefit of, under 35 U.S.C. § 119(a), Patent Application No. 201621258588.1 filed in P.R. China on Nov. 23, 2016, the entire content of which is hereby incorporated by reference.

FIELD OF THE INVENTION

The present invention relates to a plug connector, and more particularly to a plug connector which can effectively dissipate heat and has thinning tendency.

BACKGROUND OF THE INVENTION

A known universal serial bus (USB) Type-C plug connector includes an insulating body, multiple terminals arranged on the insulating body and a cable connected to multiple terminals. The insulating body has a base, a mating portion formed by extending forwards from the base and a soldering wire plate formed by extending backwards from the base. A mating slot is formed by recessing the mating portion from front to back. The multiple terminals include two power terminals. The two power terminals each are of a tuning fork type structure. Each power terminal has two contacting portions protruding and extending into the mating slot at the upper and lower sides of the mating slot and being aligned up and down. The two power terminals are electrically connected at the tail ends of the terminals via a bridging portion. The bridging portion extends backward to form a soldering portion. The soldering portion is sustained by the soldering wire plate, and is used for soldering a power wire of the cable.

In the plug connector with the foregoing structure, the two power terminals meet the electricity transmission by one power wire, the diameter of the power wire needs to be set larger. Further, the plug connector needs to meet the arrangement of the power wire in the height direction, such that the overall height of the plug connector is higher. In addition, the power wire generates more heat during the electricity transmission, resulting in a poor heat dissipation effect.

Therefore, a heretofore unaddressed need exists in the art to address the aforementioned deficiencies and inadequacies.

SUMMARY OF THE INVENTION

In one aspect, the present invention relates to a plug connector that is thin and can effectively dissipate heat.

In certain embodiments, a plug connector includes an insulating body, two power terminals, and a cable. The insulating body has a mating portion at the front end thereof. A mating slot is recessed in the mating portion from front to back, for the a tongue of a socket connector to be inserted therein. The mating slot has a first width in a left-right direction. The two power terminals are arranged on the insulating body. Each power terminal has at least one contacting portion protruding and extending into the mating slot. The two power terminals are connected with each other electrically and are provided with a second soldering portion. The second soldering portion has a second width in the left-right direction. The second width is greater than one third of the first width. The cable has at least two power wires. The at least two power wires are connected to the second soldering portion.

In certain embodiments, there are three power wires, and the three power wires are arranged side by side in the left-right direction on the second soldering portion.

In certain embodiments, the second soldering portion is arranged close to one side of the mating slot in the left-right direction.

In certain embodiments, the plug connector further includes two ground terminals located on two sides of the two power terminals, and the second soldering portion protrudes and extends beyond the ground terminal of the corresponding side in the left-right direction.

In certain embodiments, the second soldering portion has a front-back direction portion and a left-right direction portion extending toward one side from the front-back direction portion, and the front-back direction portion and the left-right direction portion are respectively soldered on at least one power wire.

In certain embodiments, the left-right direction portion is connected to the two power wires arranged side by side.

In certain embodiments, the plug connector further includes a detection terminal located between the two power terminals, and two ground terminals located on two sides of the two power terminals. The detection terminal has a third soldering portion, and the cable has a detection wire connected to the third soldering portion.

In certain embodiments, both the two power terminals and the two ground terminals are arranged symmetrically in the left-right direction on the insulating body, and at least one of the power wires is located between the ground terminal and the power terminal of the same side in the left-right direction.

In certain embodiments, the two ground terminals are connected electrically through a second bridging portion, the insulating body has a stopping block located behind the second bridging portion, and the stopping block enables the detection wire and the second bridging portion to be arranged separately in the front-back direction.

In certain embodiments, the insulating body is provided with a supporting plate and a soldering wire plate extending backward. The supporting plate and the soldering wire plate are arranged separately in the up-down direction. The supporting plate is configured to sustain the third soldering portion, and the soldering wire plate is configured to sustain the second soldering portion.

In certain embodiments, the plug connector further includes a latch member. The latch member has a connecting portion and two locking arms located on two sides of the connecting portion and electrically connected to the connecting portion. The two locking arms are located on two sides of the mating portion and separately have a locking portion protruding and extending into the mating slot, and the locking portions are used for engaging with a buckling slot of a tongue.

In certain embodiments, the third soldering portion and the second soldering portion are respectively located at the upper and lower sides of the connecting portion.

In certain embodiments, each ground terminal is connected electrically to the latch member, a first soldering portion extends backward from the connecting portion, and the cable has a ground wire connected to the first soldering portion.

In certain embodiments, the first soldering portion, the second soldering portion and the third soldering portion are located within planes at different heights in the up-down direction.

In certain embodiments, the ground wire, the power wire and the detection wire are respectively soldered correspondingly on the first soldering portion, the second soldering portion and the third soldering portion on the same side of the insulating body.

In certain embodiments, the two ground terminals are connected electrically to each other and extend a conducting portion, the conducting portion is located on one side of the first soldering portion in the up-down direction, and the ground wire is soldered on both the conducting portion and the first soldering portion.

In certain embodiments, the insulating body is provided with a limiting block located on one side of the conducting portion, and the limiting block limits the conducting portion from deflecting outward in the left-right direction.

In certain embodiments, each ground terminal has an opening and two clamping arms located on the upper and lower sides of the opening, and the two clamping arms elastically urge against the connecting portion in the up-down direction.

In certain embodiments, the insulating body is provided with multiple terminal slots. A sheet metal is blanked to form the power terminals. Each power terminal has a fixing portion, the plane of which is arranged vertically, and an extending portion and a first tail portion, which are located on the front and rear sides of the fixing portion. The fixing portion is retained in the terminal slot. The extending portion has two elastic arms which are arranged oppositely in the up-down direction. Each elastic arm is provided with a contacting portion. The two power terminals are connected electrically at the first tail portions through a first bridging portion. The first tail portions are suspended in the terminal slots.

In certain embodiments, the plug connector further includes a metal shell sheathed outside the insulating body. An open slot is provided in each of two sides of the mating portion and accommodates the corresponding locking arm, and protruding ribs protrude from an outer surface of the mating portion, are located above and below the open slots, and are in interference fit with the metal shell.

Compared with the related art, certain embodiments of the present invention are characterized in that the two power terminals are electrically connected with each other and are provided with the second soldering portion, and at least two power wires are connected to the second soldering portion. Compared with adopting one thicker power wire for electricity transmission in the related art, the present invention has the advantages that the diameter of each power wire can be arranged thinner and the electricity of the transmission is small, such that each power wire generates relatively less heat, and the surface area of the multiple power wires is larger, therefore, the heat dissipation effect is relatively good, and the overall height of the plug connector can be arranged thinner. Moreover, the mating slot has the first width in a left-right direction, the second soldering portion has the second width in the left-right direction, and the second width is greater than one third of the first width, such that the second soldering portion has enough width to connect with the multiple power wires.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
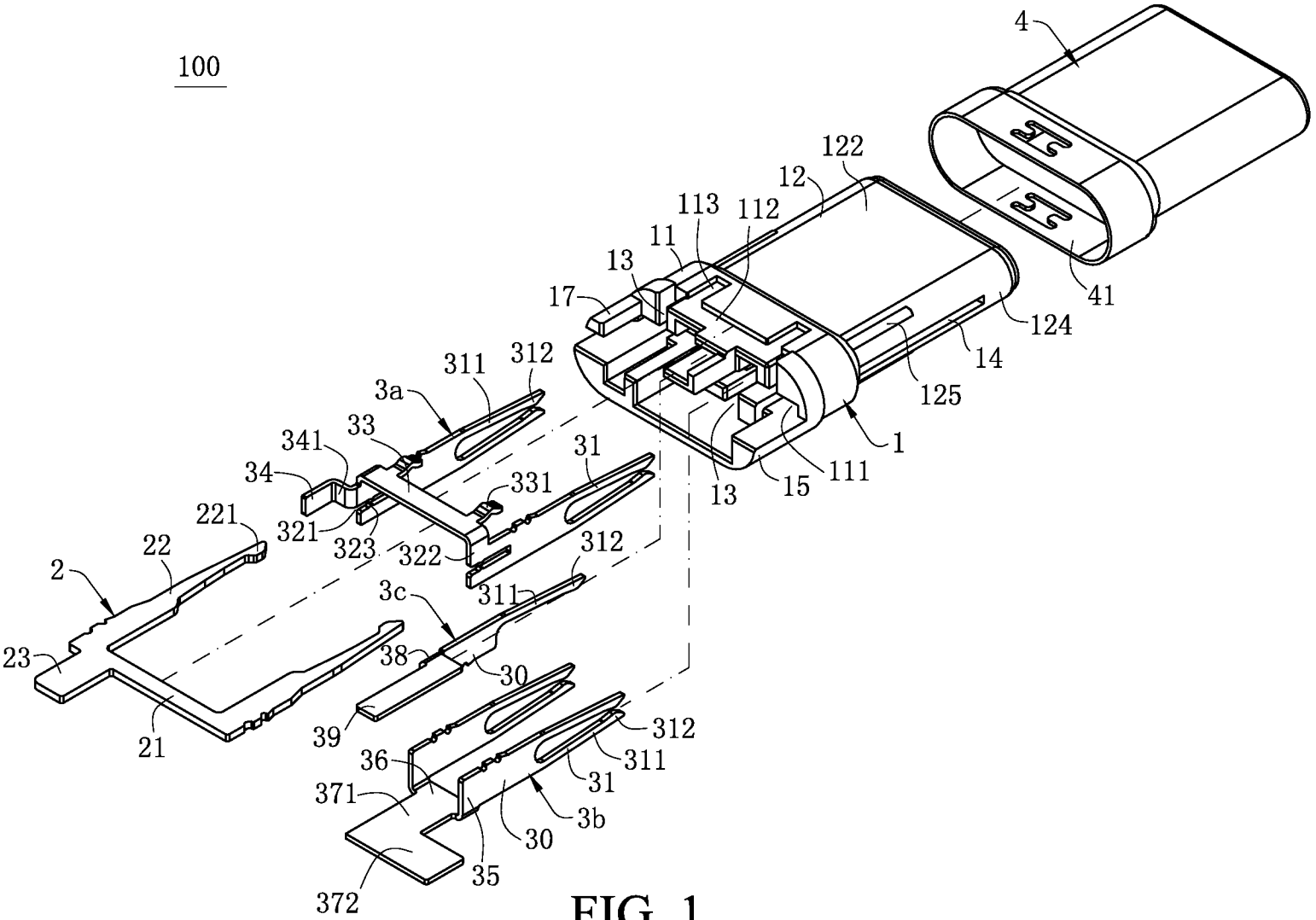
FIG. 1 is a schematic three-dimensional exploded view of a plug connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to a plug connector.

Figure 2:
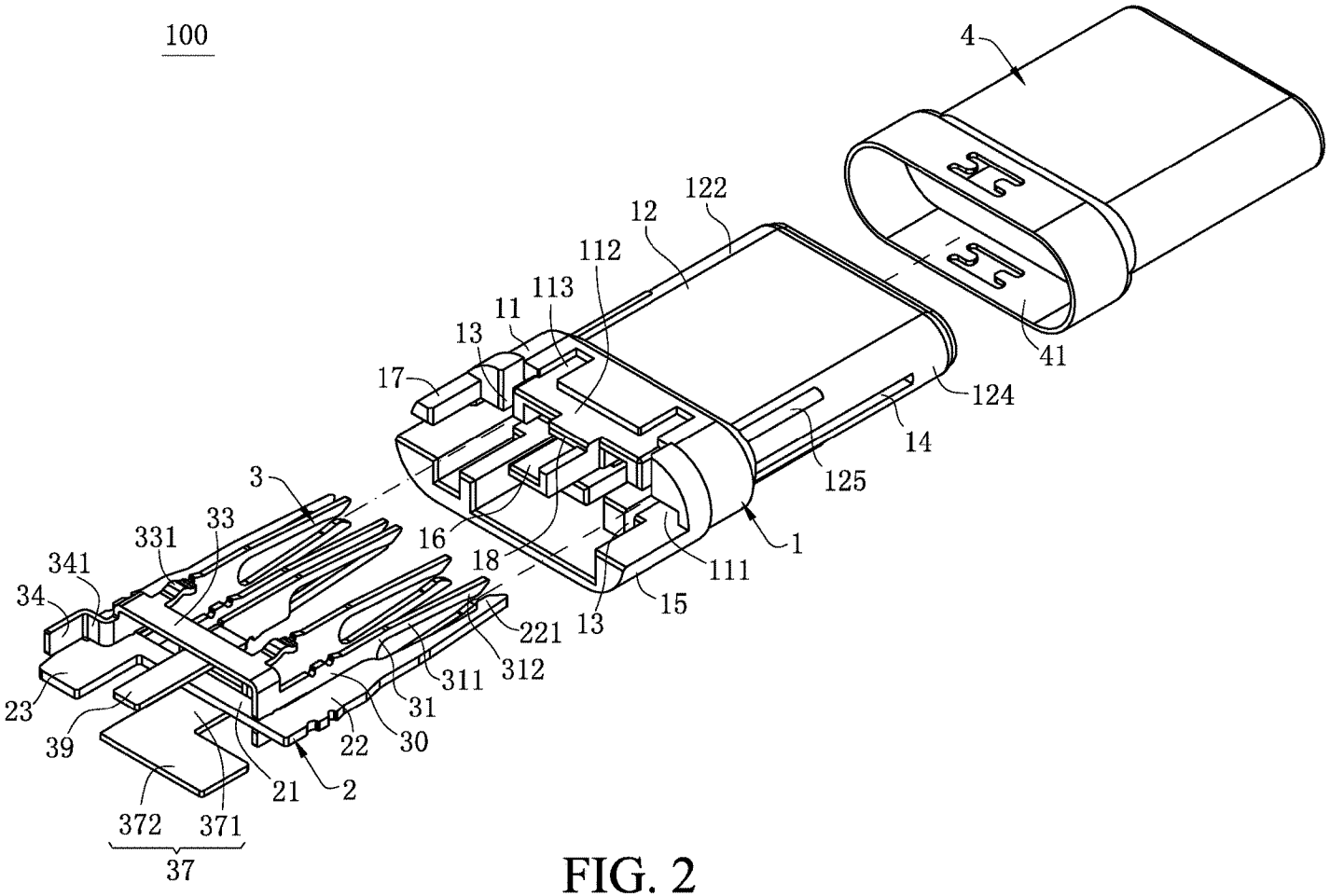
FIG. 2 is a schematic three-dimensional view of a relative position relationship between a terminal and a latch member in FIG. 1.
Figure 3:
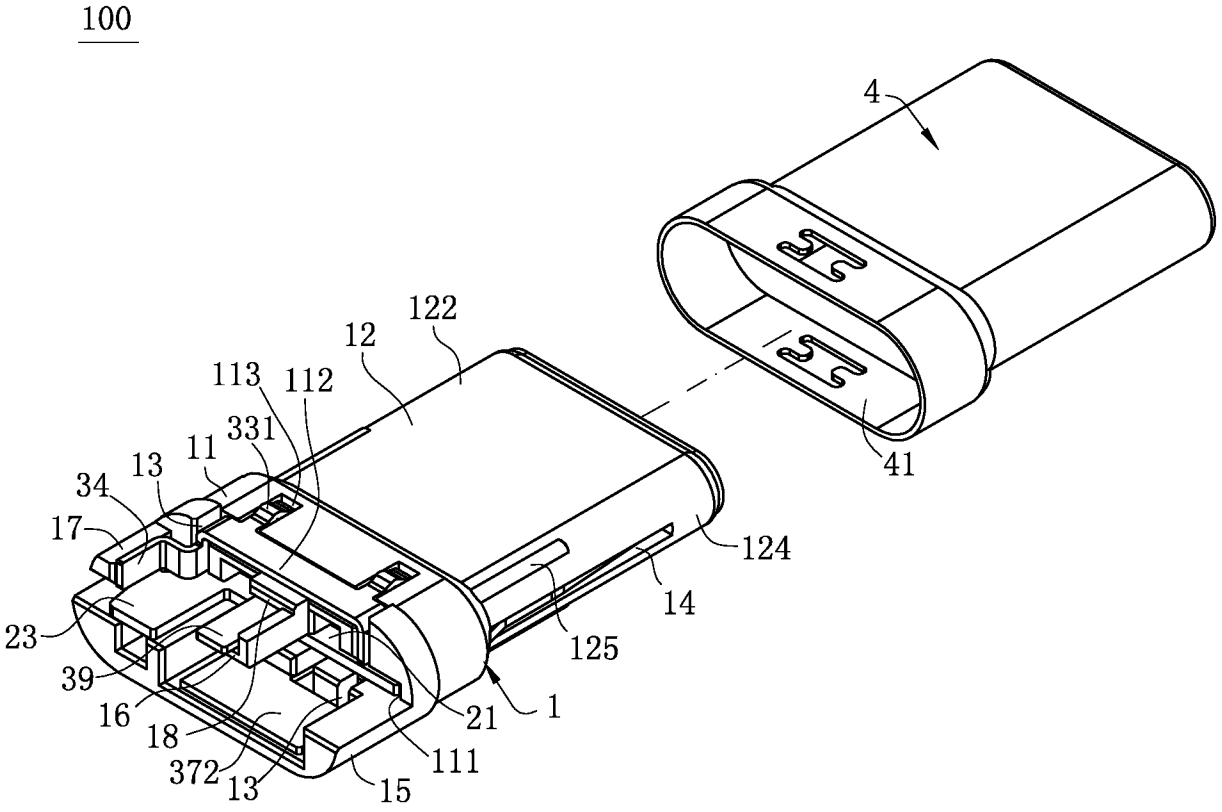
FIG. 3 is a schematic three-dimensional view of the terminal and the latch member in FIG. 2 assembled to an insulating body.
Figure 6:
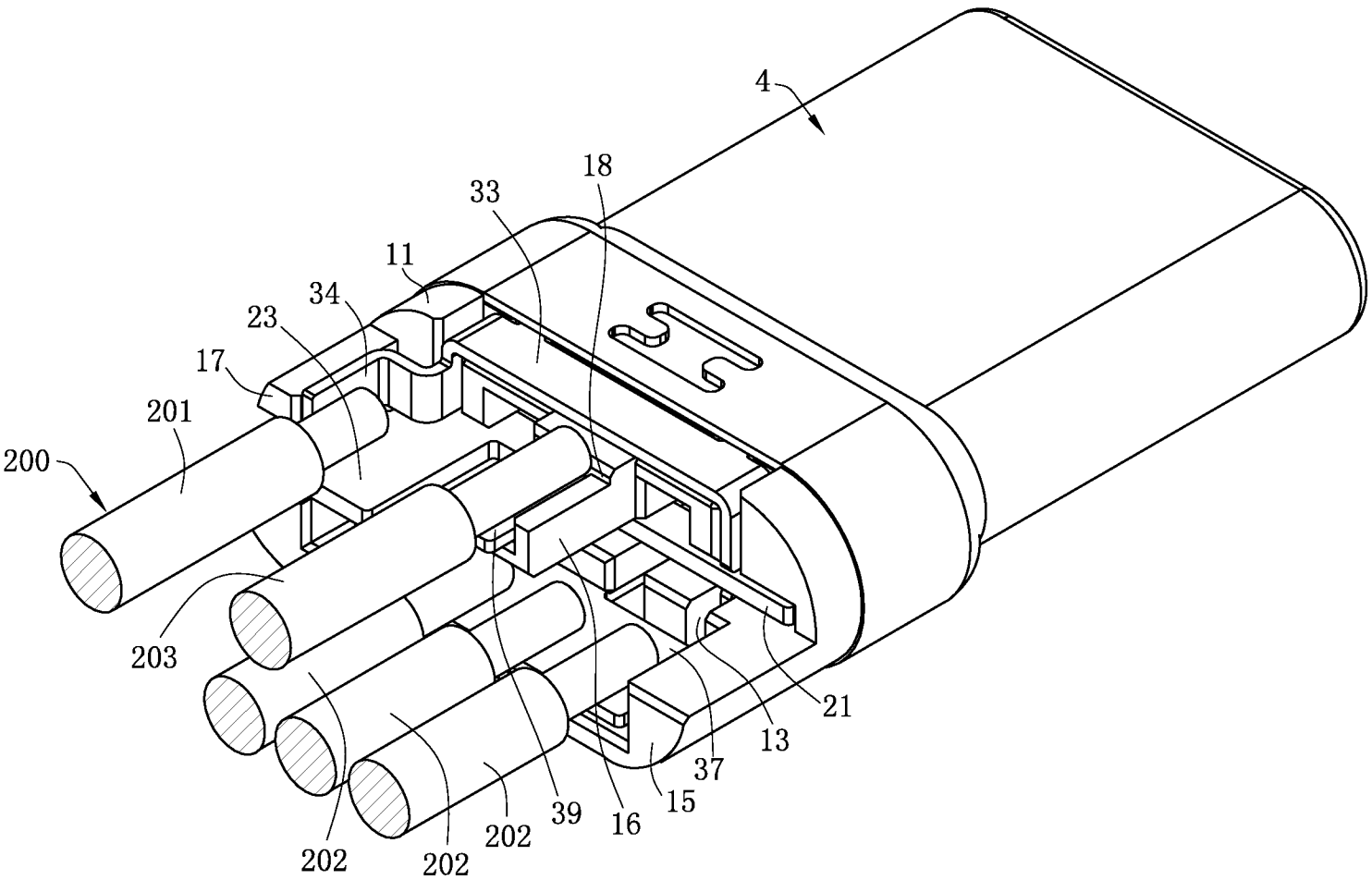
FIG. 6 is a schematic three-dimensional view of the terminal and the latch member in FIG. 3 soldered with a cable after being assembled to the insulating body and, FIG. 7 is a partial sectioned view of the insulating body and soldering between a power wire and a power terminal in FIG. 3.

Referring to FIGS. 1, 2 and 6, a plug connector 100 of a first embodiment of the present invention includes an insulating body 1, a latch member 2 arranged on the insulating body 1, multiple terminals 3 arranged on the insulating body 1, and a metal shell 4 sheathed outside the insulating body 1. The plug connector 100 is used for being connected to a cable 200. For convenience of understanding, the accompanying drawings of the present invention adopt a three-dimensional coordinate system, where X represents forward direction, Y represents rightward direction, and Z represents upward direction.

Referring to FIG. 1, the insulating body 1 has a base 11 and a mating portion 12 formed by extending forwards from the base 11. A clamping slot 111 is formed by recessing a rear end surface of the base 11 from back to front. The clamping slot 111 is located in the middle of the base 11 in an up-down direction. A recessed portion 112 and two receiving slots 113 are formed by inwardly recessing an outer surface of the upper side of the base 11 respectively. The recessed portion 112 penetrates backwards through the rear end surface of the base 11. The two receiving slots 113 are located on two sides in front of the recessed portion 112, and the receiving slots 113 and the recessed portion 112 are communicated in a front-back direction.

Figure 9:
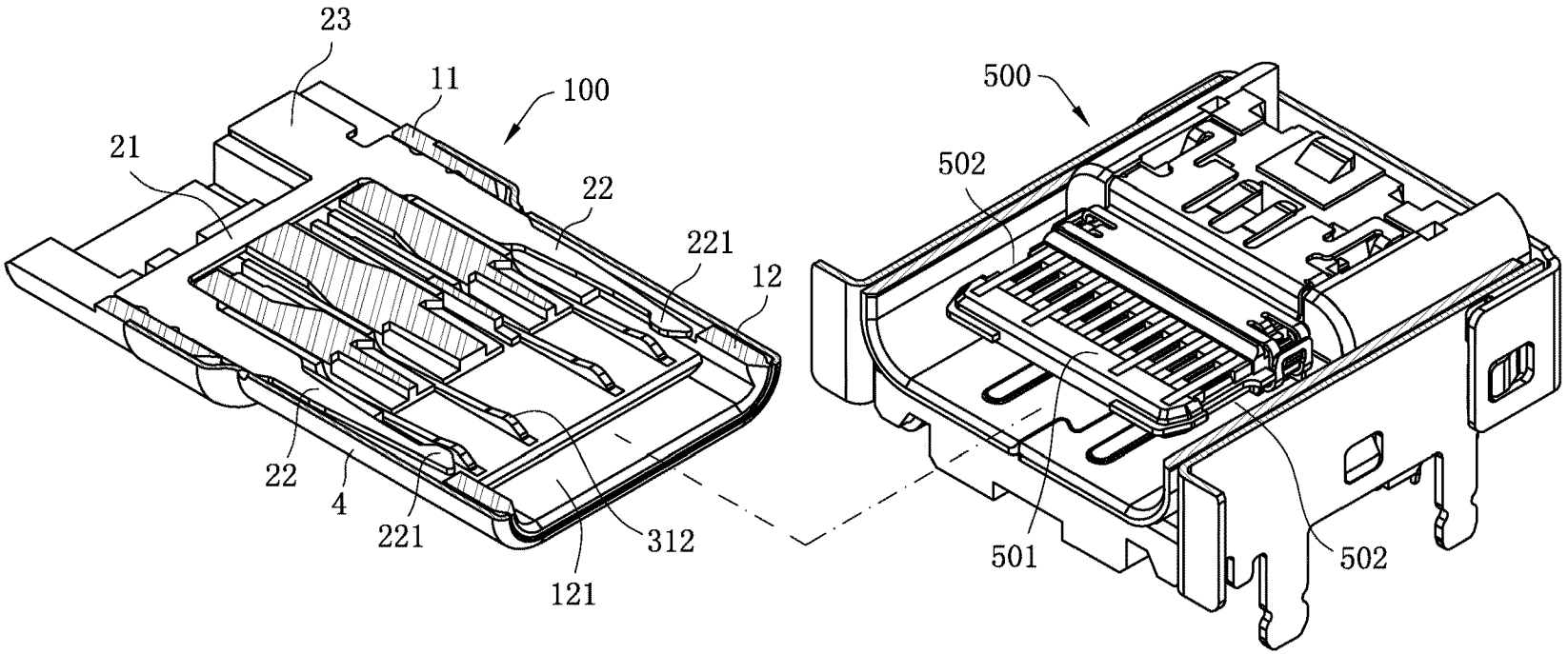
FIG. 9 is a three-dimensional section view of a plug connector and a mating socket connector.

Referring to FIGS. 1, 4, 5A and 5B, the mating portion 12 has a front end surface (not shown), a mating slot 121 formed by backward recessing from the front end surface, a top plate 122 located above the mating slot 121, a bottom plate 123 located below the mating slot 121, and two side plates 124 located on two sides of the mating slot 121. A tongue 501 of a socket connector 500 may be inserted into the mating slot 121 in dual orientation (as shown in FIG. 9). The mating slot 121 has a first width D1 in a left-right direction. That is, the distance between the two side plates 124 in the left-right direction is the first width D1.

Figure 4:
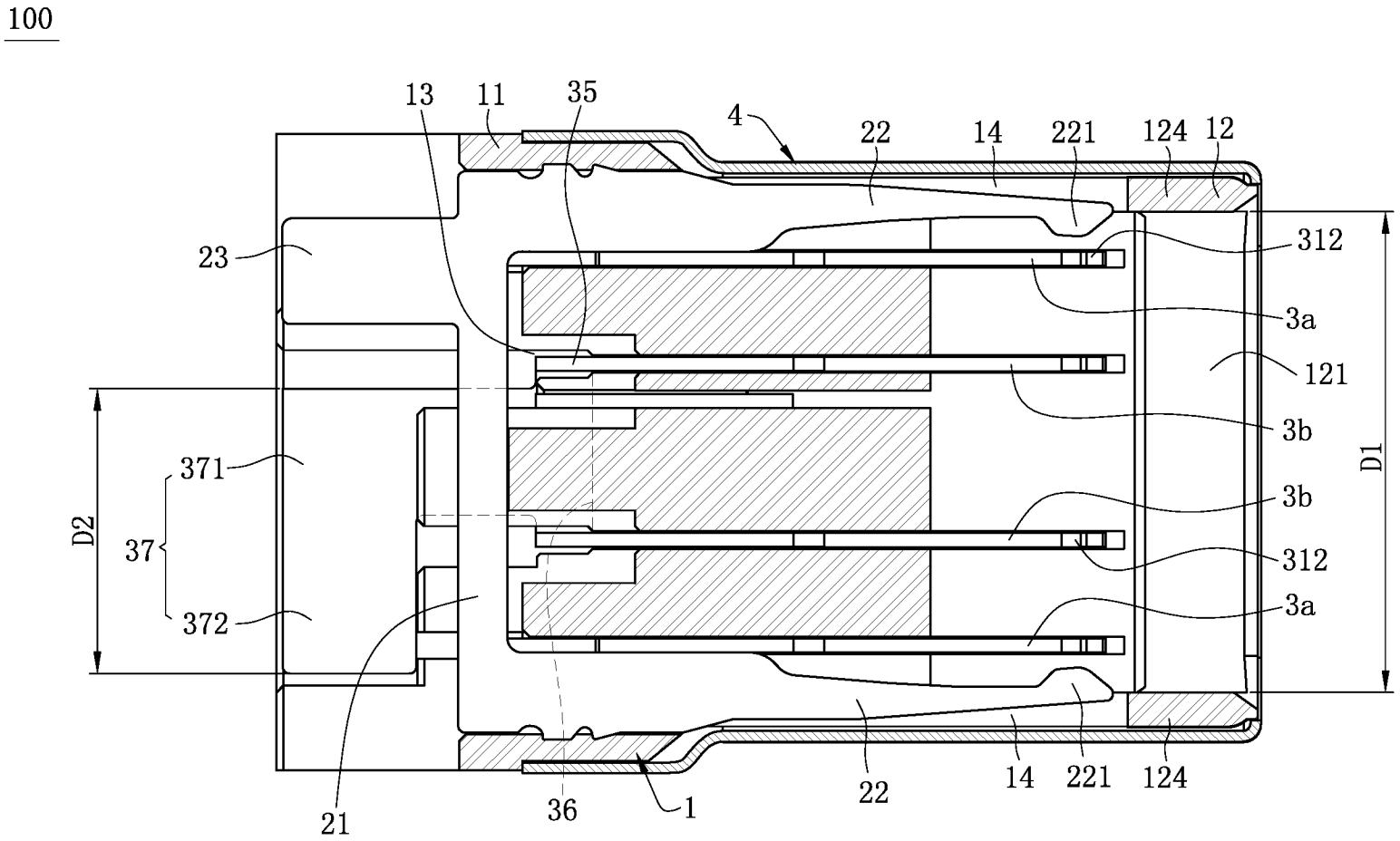
FIG. 4 is a section view of the insulating body in FIG. 3 after being assembled to a metal shell.

Referring to FIG. 1 and FIG. 4, the insulating body 1 has multiple terminal slots 13 and two open slots 14. The terminal slots 13 extend from the base 11 to the top plate 122 and the bottom plate 123. The two open slots 14 are located on two sides of the insulating body 1. The open slots 14 extend from the base 11 to the side plates 124, and are communicated with the mating slot 121 and the clamping slot 111 respectively. An outer surface of the mating portion 12 is respectively provided with a protruding rib 125 in a protruding way above and below each open slot 14.

Figure 5A:
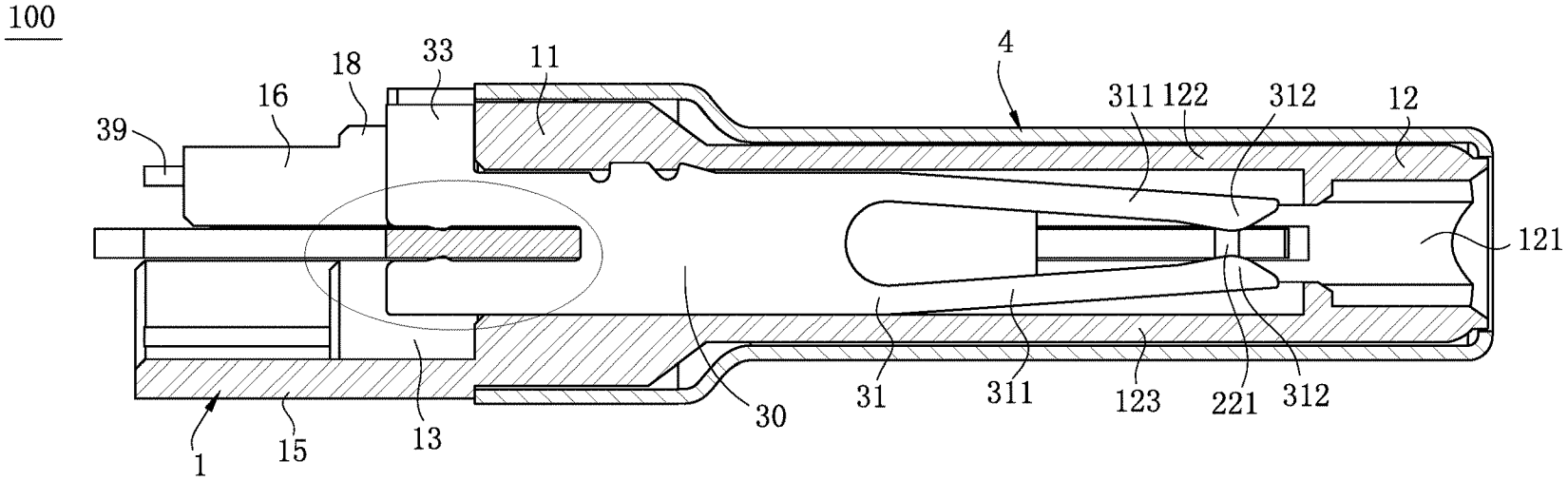
FIG. 5A is another section view of the insulating body in FIG. 3 after being assembled to the metal shell.
Figure 5B:
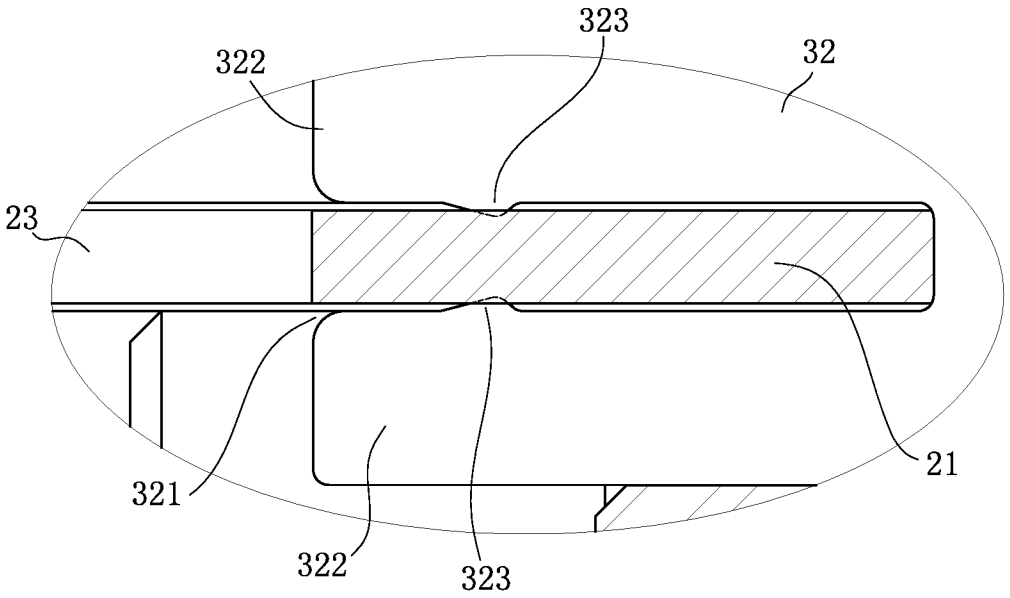
FIG. 5B a local enlarged view of the plug connector in FIG. 5A.

Referring to FIG. 1, FIG. 5A and FIG. 5B, the insulating body 1 extend backward from the base 11 a soldering wire plate 15, a supporting plate 16 and a limiting block 17. The soldering wire plate 15 and the supporting plate 16 are arranged separately in an up-down direction. The supporting plate 16 is substantially located at a middle position of the insulating body 1 in a left-right direction, and is substantially located on the lower side of the insulating body 1 in the up-down direction. The limiting block 17 is substantially located at a position close to one side of the insulating body 1 in the left-right direction. The insulating body 1 is further provided with a stopping block 18 protruding and extending backward from the base 11. The stopping block 18 and the supporting plate 16 are arranged oppositely in the up-down direction. The stopping block 18 is located behind the recessed portion 112.

Referring to FIGS. 1, 4 and 6, the latch member 2 has a connecting portion 21 and two locking arms 22 located on two sides of the connecting portion 21 and electrically connected to the connecting portion 21. In the present embodiment, the latch member 2 is formed by blanking a sheet metal. That is, the connecting portion 21 and the locking arms 22 are integrally formed and are located in the same horizontal plane. The connecting portion 21 extends in the left-right direction, and is retained in the clamping slot 111. Each locking arm 22 is arranged in the corresponding open slot 14 and has a locking portion 221 protruding and extending into the mating slot 121. The locking portions 221 are used for engaging with a buckling slot 502 of the tongue 501. The latch member 2 is provided with a first soldering portion 23 behind the connecting portion 21. The first soldering portion 23 is close to one side of the connecting portion 21, and is sustained above the soldering wire plate 15. The locking arms 22 and the first soldering portion 23 are located in the same plane.

Referring to FIGS. 1, 2 and 4, the terminals 3 are respectively received in the terminal slots 13. The terminals 3 include multiple ground terminals 3*a*, multiple power terminals 3*b* and a detection terminal 3*c*. The terminals 3 are formed by blanking sheet metals. In the present embodiment, the plug connector 100 is of a simple USB Type-C structure, and there are two ground terminals 3*a*, two power terminals 3*b* and one detection terminal 3*c*. The ground terminals 3*a* and the power terminals 3*b* each are of a tuning fork type structure, and the two ground terminals 3*a* and the two power terminals 3*b* are arranged on the insulating body 1 in a bilaterally symmetrical manner.

Referring to FIGS. 1, 2, 5A and 5B, each terminal 3 has a fixing portion 30 retained in corresponding one of the terminal slots 13, and a plate surface of each fixing portion 30 is arranged vertically. An extending portion 31 is formed by extending from the front of the fixing portion 30, and a plate surface of the extending portion 31 is arranged vertically likewise. The extending portion 31 of each of the ground terminals 3*a* and the power terminals 3*b* has two contacting arms 311 arranged oppositely up and down. The two contacting arms 311 are located on the top plate 122 and the bottom plate 123 respectively. A contacting portion 312 is formed by protrusion and extension of each contacting arm 311 to the mating slot 121. The contacting portions 312 of the two contacting arms 311 are aligned up and down. The extending portion 31 of the detection terminal 3*c* only has a contacting arm 311 arranged on the top plate 122 or the bottom plate 123.

Referring to FIGS. 1, 2, 5A and 5B, each ground terminal 3*a* has a first tail portion 32 extending backward from the fixing portion 30 thereof. A plate surface of the first tail portion 32 is arranged vertically, such that the plate surface of the first tail portion 32 is perpendicular to a plate surface of the latch member 2. Each first tail portion 32 is suspended in the corresponding terminal slot 13. That is, a clearance is provided between each first tail portion 32 and the periphery of the corresponding terminal slot 13. Each first tail portion 32 has an opening 321. The opening 321 is formed by forward recessing from a rear edge of the first tail portion 32, and a clamping arm 322 is formed at the first tail portion 32 and is located at each of the upper and lower sides of the opening 321. The clamping arms 322 are elastic. Each clamping arm 322 is provided with a protrusion 323 in a protruding way to the inside of the opening 321. The connecting portion 21 is located at the opening 321, and the clamping arms 322 elastically urge against the connecting portion 21 in the up-down direction, such that the protrusions 323 are in tight contact with the connecting portion 21, thus enabling the two ground terminals 3*a* to keep good ground paths with the latch member 2. The two ground terminals 3*a* are electrically connected at the first tail portions 32 via a first bridging portion 33. The first bridging portion 33 is arranged in the recessed portion 112. Two ground elastic sheets 331 integrally extend forwards from a front end of the bridging portion 33. The two ground elastic sheets 331 are correspondingly accommodated in the two receiving slots 113, and protrude out of an outer surface of the base 11 to be in contact with the metal shell 4 so as to be grounded. The first tail portion 32 of one of the two ground terminals 3*a* is integrally connected to a conducting portion 34, and the conducting portion 34 is located on one side of the first soldering portion 23 in the up-down direction. In the present embodiment, the conducting portion 34 is connected to the corresponding upper clamping arm 322, and the conducting portion 34 shifts outward relative to the first tail portion 32 by means of a bending portion 341, such that the conducting portion 34 is relatively close to the outer side of the first soldering portion 23. The limiting block 17 is located on the outer side of the conducting portion 34, and limits the conducting portion 34 from outward deflecting in a left-right direction. In the present embodiment, the two ground terminals 3*a*, the first bridging portion 33, the two ground elastic sheets 331 and the conducting portion 34 are integrally formed by a sheet metal.

Referring to FIGS. 1, 2 and 4, each power terminal 3*b* has a second tail portion 35 extending backward from the fixing portion 30 thereof, and a plate surface of the second tail portion 35 is arranged vertically likewise. Each second tail portion 35 is suspended in the corresponding terminal slot 13. That is, a clearance is provided between each second tail portion 35 and the periphery of the corresponding terminal slot 13. The two power terminals 3*b* arranged in a symmetrical manner are electrically connected at the second tail portion 35 by means of a second bridging portion 36. The second bridging portion 36 is located in front of the connecting portion 21. A second soldering portion 37 is formed by extending backward from the second bridging portion 36 and across the connecting portion 21. The second soldering portion 37 is also sustained above the soldering wire plate 15. The second soldering portion 37 is close to one side of the mating slot 121 in a left-right direction. The second soldering portion 37 is provided with a second width D2 in the left-right direction, and the second width D2 is greater than one third of the first width D1. The second soldering portion 37 has a front-back direction portion 371 and a left-right direction portion 372 extending to one side from the front-back direction portion 371. The second soldering portion 37 protrudes and extends beyond the ground terminal 3*a* of the corresponding side in the left-right direction. That is, the left-right direction portion 372 protrudes and extends beyond the ground terminal 3*a* on the corresponding side in the left-right direction. In the present embodiment, the two power terminals 3*b*, the second bridging portion 36 and the second soldering portion 37 are integrally formed by a sheet metal.

Referring to FIG. 1 and FIG. 2, the detection terminal 3*c* has a third tail portion 38 extending backward from the fixing portion 30 thereof. A plate surface of the third tail portion 38 is arranged vertically likewise. The third tail portion 38 is located in front of the connecting portion 21. The third tail portion 38 is suspended in the corresponding terminal slot 13. That is, a clearance is provided between the third tail portion 38 and the periphery of the corresponding terminal slot 13. A third soldering portion 39 is formed by bending one of the upper and lower opposite sides of the third tail portion 38 and extending backward and across the connecting portion 21. The third soldering portion 39 is located between the supporting plate 16 and the stopping block 18 in an up-down direction. The third soldering portion 39 is sustained by the supporting plate 16, preventing the third soldering portion 39 from excessively deforming download during soldering, which leads to short circuit when contacting with the power wire 202 below the third soldering portion 39. Plate surfaces of the first soldering portion 23, the second soldering portion 37 and the third soldering portion 39 are all arranged horizontally, and are located in planes at different heights in the up-down direction.

Referring to FIG. 1, the metal shell 4 is of a seamlessly connected tubular structure formed by a drawing and printing process, and has an receiving cavity 41. The insulating body 1 is accommodated in the receiving cavity 41. The protruding ribs 125 are in interference fit with the metal shell 4 to enable the metal shell 4 and the insulating body 1 to be tightly immobilized together.

Figure 7:
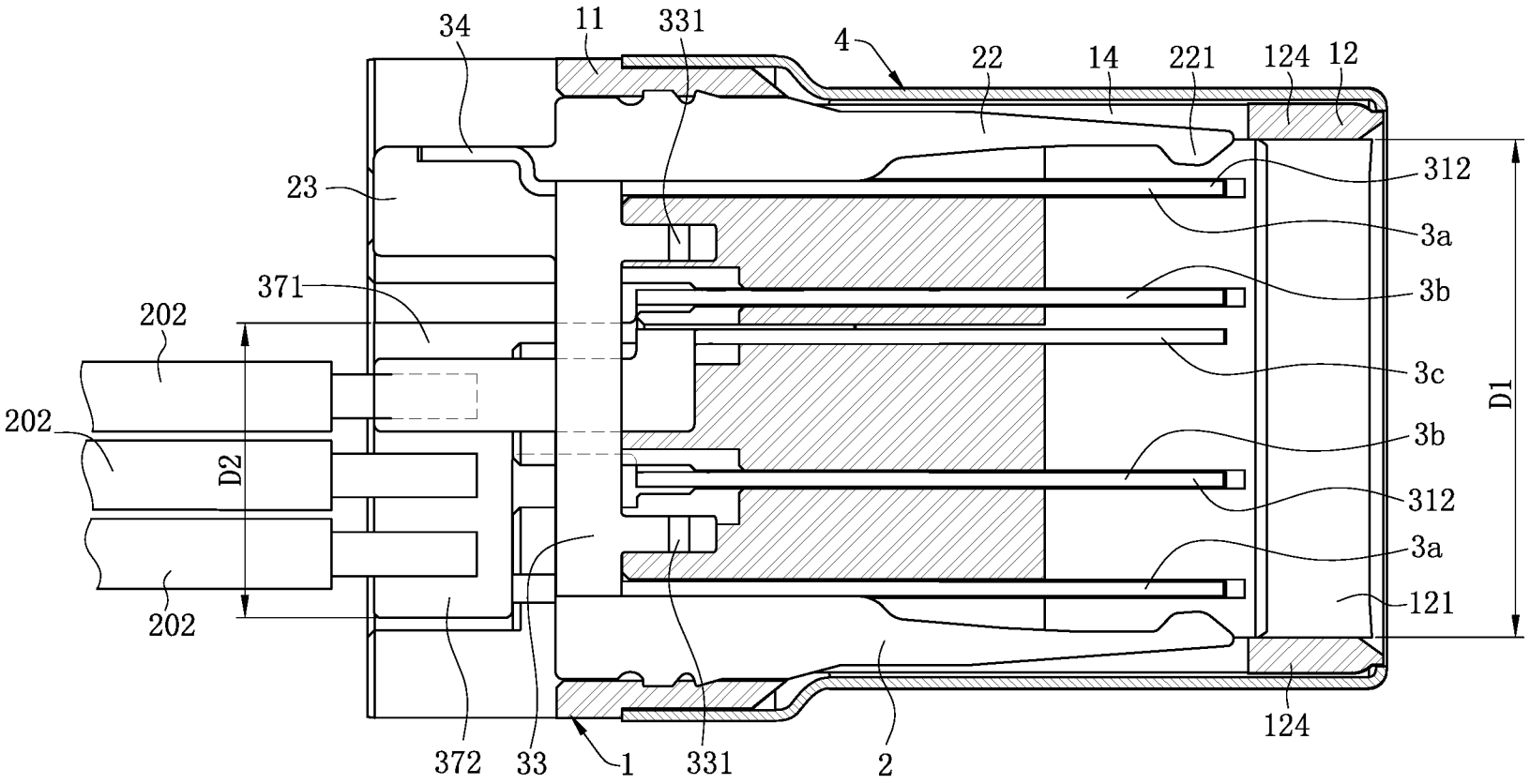

Referring to FIGS. 1, 6 and 7, the cable 200 includes a ground wire 201, multiple power wires 202 and a detection wire 203. An inner conductor (not labeled) of the ground wire 201 is arranged on the first soldering portion 23 and urges the conducting portion 34. The inner conductor of the ground wire 201, the first soldering portion 23 and the conducting portion 34 are soldered together using tin material (not shown), such that the three portions may be well grounded. Inner conductors (not labeled) of the multiple power wires 202 are arranged on the second soldering portion 37 side by side in a left-right direction, and are soldered and form electrical connection with the second soldering portion 37. The front-back direction portion 371 and the left-right direction portion 372 respectively solder at least one power wire 202, and at least one power wire 202 is located between the ground terminal 3*a* and the power terminal 3*b* on the same side in the left-right direction. In the present embodiment, there are three power wires 202, one of the three power wires 202 is soldered to the front-back direction portion 371, and the other two power wires are soldered to the left-right direction portion 372. An inner conductor (not labeled) of the detection wire 203 is arranged on the third soldering portion 39 correspondingly. The ground wire 201, the power wires 202 and the detection wire 203 are respectively soldered to the first soldering portion 23, the second soldering portion 37 and the third soldering portion 39 correspondingly on the same side of the insulating body 1, such that there is no need for overturning the plug connector 100 to complete the soldering of three different function wires.

Figure 8:
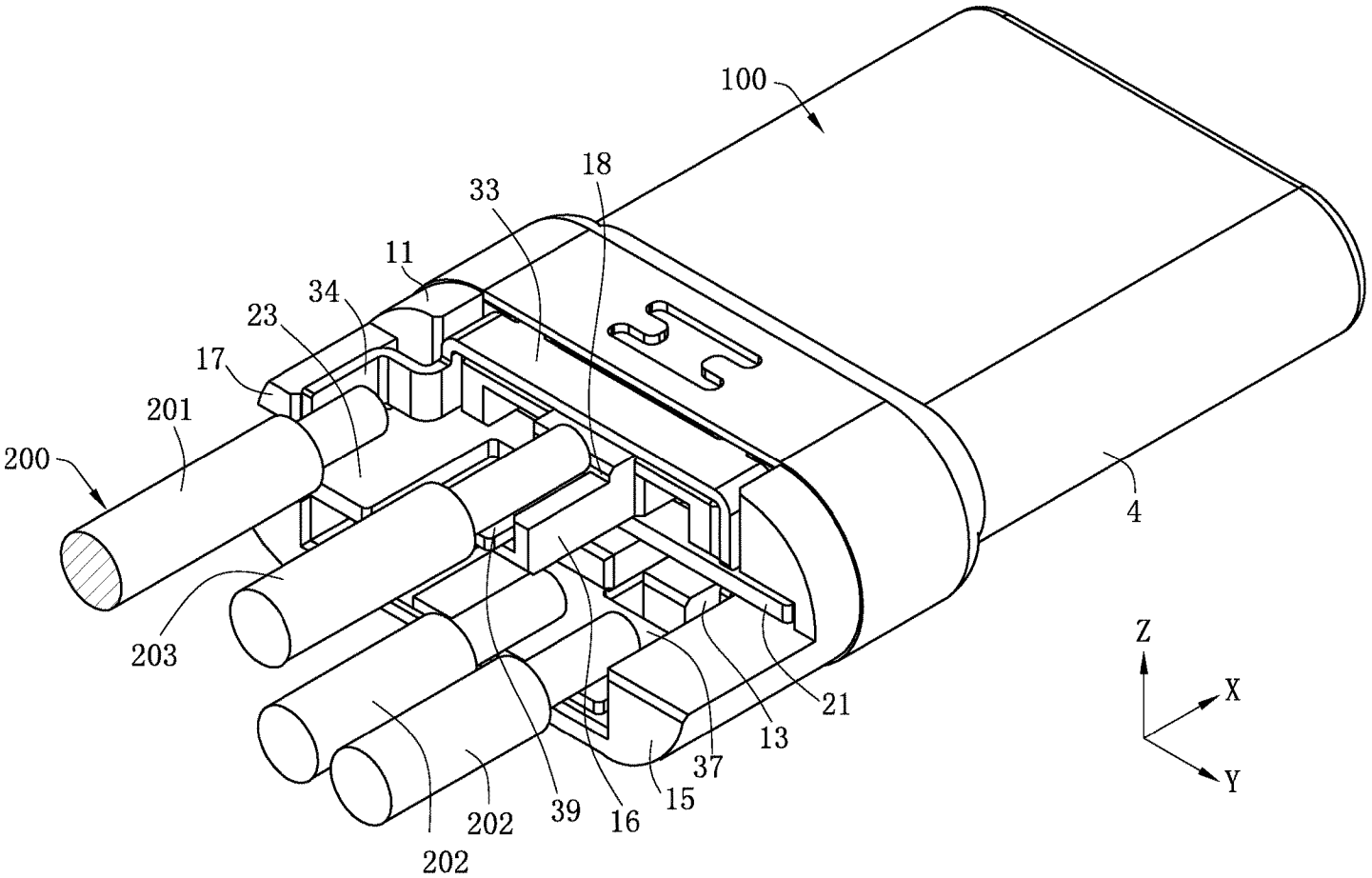
FIG. 8 is a schematic three-dimensional combined view of a second soldering portion of the power terminal connected to two power wires according to one embodiment of the present invention.

Referring to FIG. 2 and FIG. 8, of course, in other embodiments, the cable 200 may also be provided with two power wire 202 arranged on the second soldering portion 37 side by side in a left-right direction, and soldered to the second soldering portion 37 to form electrical connection, and the front-back direction portion 371 and the left-right direction portion 372 are respectively soldered to one of the power wires 202.

In summary, the plug connector according to certain embodiments of the present invention, among other things, has the following beneficial advantages:

1. The two power terminals 3*b* are electrically connected with each other, and are provided with the second soldering portion 37, and the at least two power wires 202 are connected to the second soldering portion 37. Compared with adopting one thicker power wire for electricity transmission in the related art, the present invention has the advantages that the diameter of each power wire 202 can be arranged thinner and transmitted electricity is small, such that each power wire 202 generates relatively less heat, the surface area of the multiple power wires 202 is larger, therefore, the heat dissipation effect is relatively good, and the overall height of the plug connector 100 can be arranged thinner. Moreover, the mating slot 121 has the first width D1 in a left-right direction, the second soldering portion 37 has the second width D2 in the left-right direction, and the second width D2 is greater than one third of the first width D1, such that the second soldering portion 37 has enough width to connect with the multiple power wires 202.

2. The insulating body 1 has the stopping block 18 located behind the second bridging portion 36, and the stopping block 18 enables the detection wire 203 and the second bridging portion 36 to be separately arranged in the front-back direction, preventing the ground terminals 3*a* and the detection terminal 3*c* from being short-circuited.

3. The clamping arms 322 are elastic, and elastically urge against the connecting portion 21 in the up-down direction, such that the two ground terminals 3*a* may be in tight contact with the latch member 2, thus keeping a good ground path therebetween. Moreover, the first tail portions 32 are suspended in the terminal slots 13, such that deformation spaces may be provided for the clamping arms 322 in the terminal slots 13.

4. The first tail portions 32 are suspended in the terminal slots 13, and the fixing portions 30 are located in front of the first tail portions 32, such that when the clamping arms 322 elastically urge against the connecting portion 21 in the up-down direction, an acting force therebetween cannot affect the true positions of the ground terminals 3*a*.

5. The plate surfaces of the first soldering portion 23, the second soldering portion 37 and the third soldering portion 39 are all arranged horizontally, and are located in planes at different heights in the up-down direction, such that the ground wire 201, the power wires 202 and the detection wire 203 can be soldered with the foregoing soldering portions by reasonably utilizing an effective space at the rear end of the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A plug connector, comprising:

an insulating body, wherein a front end of the insulating body has a mating portion, a mating slot is recessed from the mating portion from front to back, and the mating portion is used for a tongue of a socket connector to be inserted therein;

a latch member arranged on the insulating body, wherein the latch member comprises a connecting portion and two locking arms located on two sides of the connecting portion and connected electrically to the connecting portion, a first soldering portion extends backward from the connecting portion, the two locking arms are located on two sides of the mating portion and respectively have a locking portion protruding and extending into the mating slot, and each of the locking portions is configured to engage with a buckling slot of the tongue;

two power terminals arranged on the insulating body, wherein each of the two power terminals has at least one contacting portion protruding and extending into the mating slot, and the two power terminals are electrically connected to each other and are provided with a second soldering portion;

two ground terminals located on two sides of the two power terminals and arranged on the insulating body, wherein each of the two ground terminals is electrically connected to the latch member, the two ground terminals are electrically connected to each other and connected to a conducting portion, the conducting portion is located on one side of the first soldering portion in an up-down direction; and a cable having at least two power wires and a ground wire, wherein the at least two power wires are connected to the second soldering portion, and the ground wire is soldered on both the conducting portion and the first soldering portion.

2. The plug connector of claim 1, wherein the at least two power wires comprises three power wires, and the three power wires are arranged side by side in a left-right direction on the second soldering portion.

3. The plug connector of claim 1, wherein the second soldering portion is arranged close to one side of the mating slot in a left-right direction.

4. The plug connector of claim 3, wherein the second soldering portion protrudes and extends beyond the two ground terminals on corresponding sides in the left-right direction.

5. The plug connector of claim 1, wherein the second soldering portion has a front-back direction portion and a left-right direction portion extending to one side from the front-back direction portion, and the front-back direction portion and the left-right direction portion are respectively soldered on at least one of the at least two power wires.

6. The plug connector of claim 5, wherein the left-right direction portion is connected to two of the at least two power wires arranged side by side.

7. The plug connector of claim 1, further comprising:

a detection terminal located between the two power terminals and arranged on the insulating body;

wherein the detecting terminal has a third soldering portion, and the cable has a detection wire connected to the third soldering portion.

8. The plug connector of claim 7, wherein both the two power terminals and the two ground terminals are arranged symmetrically in a left-right direction on the insulating body, and at least one of the at least two power wires is located between one of the ground terminals and one of the power terminals on the same side in the left-right direction.

9. The plug connector of claim 7, wherein the two ground terminals are connected electrically through a second bridging portion, the insulating body has a stopping block located behind the second bridging portion, and the stopping block enables the detection wire and the second bridging portion to be arranged separately in a front-back direction.

10. The plug connector of claim 7, wherein the insulating body is provided with a supporting board and a soldering wire board which extend backward, the supporting board and the soldering wire board are arranged separately in the up-down direction, the supporting board is configured to sustain the third soldering portion, and the soldering wire board is configured to sustain the second soldering portion.

11. The plug connector of claim 7, wherein the third soldering portion and the second soldering portion are located at upper and lower sides of the connecting portion.

12. The plug connector of claim 7, wherein the first soldering portion, the second soldering portion and the third soldering portion are located within planes at different heights in the up-down direction.

13. The plug connector of claim 7, wherein the ground wire, the power wires and the detection wire are respectively soldered correspondingly on the first soldering portion, the second soldering portion and the third soldering portion on a same side of the insulating body.

14. The plug connector of claim 1, wherein the insulating body is provided with a limiting block located on one side of the conducting portion, and the limiting block limits the conducting portion in a left-right direction from deflecting outward.

15. The plug connector of claim 1, wherein each of the two ground terminals has an opening and two clamping arms located on upper and lower sides of the opening, and the two clamping arms elastically urge against the connecting portion in the up-down direction.

16. The plug connector of claim 1, wherein the insulating body is provided with a plurality of terminal slots, a sheet metal is blanked to form the two power terminals, each of the two power terminals has a fixing portion, and an extending portion and a first tail portion located at the front and rear sides of the fixing portion, planes of the fixing portions are arranged vertically, the fixing portions are respectively retained in the terminal slots, each of the extending portions is provided with two elastic arms arranged oppositely in the up-down direction, each of the elastic arms is provided with a contacting portion, the two power terminals are connected electrically at the first tail portions through a first bridging portion, and the first tail portions are suspended in the terminal slots.

17. The plug connector of claim 1, further comprising a metal shell sheathed outside the insulating body, wherein two sides of the mating portion are each provided with an open slot to accommodate corresponding one of the locking arms, and two protruding ribs are respectively arranged convexly above and below each of the open slots on outer surface of the mating portion to be in interference fit with the metal shell.

18. The plug connector of claim 1, wherein the mating slot has a first width in a left-right direction, the second soldering portion has a second width in the left-right direction, and the second width is greater than one third of the first width.

19. A plug connector, comprising:

an insulating body, wherein a front end of the insulating body has a mating portion, a mating slot is recessed from the mating portion from front to back, the mating portion is used for a tongue of a socket connector to be inserted therein, two sides of the mating portion are each provided with an open slot, and two protruding ribs are respectively arranged convexly above and below each of the open slots on an outer surface of the mating portion;

a metal shell sheathed outside the insulating body, wherein the metal shell is in interference fit with the protruding ribs;

a latch member arranged on the insulating body, wherein the latch member comprises a connecting portion and two locking arms located on two sides of the connecting portion and connected electrically to the connecting portion, each of the two locking arms is accommodated in the corresponding open slot and respectively have a locking portion protruding and extending into the mating slot, and each of the locking portions is configured to engage with a buckling slot of the tongue;

two power terminals arranged on the insulating body, wherein each of the two power terminals has at least one contacting portion protruding and extending into the mating slot, and the two power terminals are electrically connected to each other and are provided with a second soldering portion; and a cable having at least two power wires, wherein the at least two power wires are connected to the second soldering portion.

20. The plug connector of claim 19, further comprising two ground terminals located on two sides of the two power terminals and arranged on the insulating body, wherein each of the two ground terminals is connected electrically to the latch member, a first soldering portion extends backward from the connecting portion, the cable has a ground wire, and the ground wire is soldered on the first soldering portion.

* * * * *